US005622924A

United States Patent [19]

Sakai et al.

[11] Patent Number: 5,622,924

[45] Date of Patent: Apr. 22, 1997

[54] VISCOSITY INDEX IMPROVER AND LUBRICATING OIL

[75] Inventors: Kouzou Sakai; Hidehiko Matsuya; Yoshihisa Ohta, all of Kyoto, Japan

[73] Assignee: Sanyo Chemical Industries, Ltd., Kyoto, Japan

[21] Appl. No.: 535,053

[22] PCT Filed: Feb. 28, 1995

[86] PCT No.: PCT/JP95/00309

§ 371 Date: Oct. 30, 1995

§ 102(e) Date: Oct. 30, 1995

[87] PCT Pub. No.: WO95/24458

PCT Pub. Date: Sep. 14, 1995

[30] Foreign Application Priority Data

Mar. 8, 1994 [JP] Japan ..... 6-065583
Oct. 27, 1994 [JP] Japan ..... 6-289007

[51] Int. Cl.[6] ..... C10M 145/00

[52] U.S. Cl. ..... 508/469; 568/470; 568/500; 568/501

[58] Field of Search ..... 252/56 R, 49.7, 252/49.8, 49.9; 508/469, 470, 500, 501; C10M 145/14

[56] References Cited

U.S. PATENT DOCUMENTS 3,788,990 1/1974 Elliott et al. ..... 252/56 R
3,833,501 9/1974 Elliott et al. ..... 252/56 R
4,776,967 10/1988 Ichihashi et al. ..... 252/32.7 E
4,822,508 4/1989 Pennewiss et al. ..... 252/56 R
4,867,894 9/1989 Pennewis et al. ..... 252/56 R
4,968,444 11/1990 Knoell et al. ..... 256/56 R
5,149,452 9/1992 Mc Alpine et al. ..... 252/56 R
5,229,021 7/1993 Pillon ..... 252/56 R

FOREIGN PATENT DOCUMENTS 734918 5/1966 Canada .

*Primary Examiner*—Prince Willis, Jr.
*Assistant Examiner*—Cephia D. Toomer
*Attorney, Agent, or Firm*—Oblon, Spivak, McClelland, Maier & Neustadt, P.C.

[57] ABSTRACT

There are disclosed a viscosity index improver comprising a polymer containing at least 70% by weight of structural units of an alkyl (meth)acryrate monomer containing not more than 10 carbon atoms in the alkyl group, and a lubrication oil, comprising said improver added to a lubrication base oll selected from the group consisting of mineral oils, MLDW oils, iso-paraffin-containing high viscosity index oils, synthetic hydrocarbon lubricating oils, synthetic ester lubricating oils, and mixture of two or more of these. The improver exhibits improved low-temperature viscosity characteristics and oxidation resistance, as compared with conventional methacrylate polymer viscosity index improvers. It gives extremely low viscosity at –40° C., particularly when used in high viscosity index oils. Besides, when used in conjunction with a molybdenum-containing FM agent, it has a characteristic of providing low friction coefficient even after oxidative degradation. Thus, lubricating oil, prepared using the improver, shows improved low-temperature flow properties and oxidative stability at high temperature, and are usable even under severe circumstances and of improved reduced fuel cost.

20 Claims, No Drawings

VISCOSITY INDEX IMPROVER AND LUBRICATING OIL

TECHNICAL FIELD

This invention relates to a viscosity index improver and a lubricating oil. More particularly, it relates to a viscosity index improver having improved viscosity index improving ability, low-temperature viscosity characteristics, oxidation resistance and reduced fuel cost, and a lubricating oil containing such viscosity index improver added thereto.

BACKGROUND ART

It has been heretofore known to add viscosity index improver comprising polyalkyl(meth)acrylate to lubricating oil. For example, U.S. Pat. No. 2,628,225 discloses to add a polyalkylmethacrylate to a lubricating oil. JPN Patent Laid-open No.12982/1972 discloses a viscosity index improver comprising copolymer having alkyl acrylate and alkyl methacrylate structural units. Polyalkyl(meth)acrylates have been used widely, since they have good viscosity index improving ability, low-temperature viscosity characteristics and accompanied by pour point depressing ability. Polyalkyl-(meth)acrylates employed heretofore contain at least 50% by weight of alkyl (meth)acrylate structural units having at least 12 carbon atoms in the alkyl group in order for them to possess pour point depressing ability. Alkyl methacrylates are mainly used as the structural units for providing much of the pour point depressing ability.

As to lubricating oils and hydraulic fluids, it is desired that their low-temperature viscosity, as well as their cost, be low, so as to meet economic needs. As a means for accomplishing this, high viscosity index oils containing iso-paraffins, synthetic lubricating oils, MLDW oils and the like are coming into wide use, and these have been used alone or in combination with usual solvent-refined mineral oils. Particularly, high viscosity index oils are becoming widely used in view of performance and cost. To use such high viscosity index oils, it has been proposed to reduce low-temperature viscosity by combining them with a pour point depressant. This is so disclosed, for instance, in JPN Patent Lay-open No. 70305/1979. There is thus a demand for a viscosity index improver suitable for these high viscosity index oils. Also, for reducing fuel cost, a molybdenum-containing friction modifier or anti-wear agent (FM agent) has been used.

Particularly, for lubricating oils for passenger cars it is necessary to improve their low-temperature viscosity characteristics and oxidation resistance, yet be of low fuel cost, in order to comply with recently established CAFE regulations and lubricating oil standards. Known polyalkyl (meth-)acrylate viscosity index improvers, are insufficient to satisfy these desired objectives of improving low-temperature viscosity characteristics and oxidation resistance and yet be of low fuel cost. Especially, in engine oils, gear oils and automatic transmission oils, attaining these objectives is desired and essential.

In addition, since known polyalkyl (meth)acrylate viscosity index improvers are of insufficient oxidation resistance and heat resistance and have poor solubility and low-temperature viscosity characteristics in high viscosity index oils and synthetic lubricating oils, good oxidation resistance and heat resistance of these base oils cannot be obtained thereby. Particularly in high viscosity index oils, known viscosity index improvers are insufficiently effective with respect to low-temperature viscosity characteristics.

Furthermore, when known viscosity index improvers and FM agents are added to lubricating oils they are subject to oxidative degradation, their friction coefficient is sharply increased, and friction wear reducing effects are not fully attained.

Applicants have discovered that a viscosity index improver comprising a polymer containing structural units of alkyl (meth)acrylate monomers having alkyl group containing a specific numbers of carbon atoms provides improved viscosity index improving ability, low-temperature viscosity characteristics and reduced fuel cost together with improved oxidation resistance, and provides for full effects of FM agents.

SUMMARY OF THE INVENTION

In accordance with the present invention, there is provided a viscosity index improver comprising a polymer (B) containing at least 70% by weight of structural units of an alkyl (meth)acrylate monomer (A) containing not more than 10 carbon atoms in the alkyl group; and a lubrication oil, comprising a lubrication base oil (D) selected from the group consisting of mineral oils, MLDW oils, iso-paraffin-containing high viscosity index oils, synthetic hydrocarbon lubricating oils, synthetic ester lubricating oils, and mixture of two or more of these, and said viscosity index improver being added thereto. Also, there is provided a lubrication oil, containing said viscosity index improver and a FM agent.

DETAILED DESCRIPTION AND BEST MODE OF THE INVENTION

Suitable alkyl (meth)acrylate monomers (A), containing not more than 10 carbon atoms in the alkyl group, include, for example, methyl (meth)acrylates, ethyl (meth)acrylates, propyl (meth)acrylates, butyl (meth)acrylates, pentyl (meth-)acrylates, hexyl (meth)acrylates, cyclohexyl (meth)acrylates, heptyl (meth)acrylates, octyl (meth)acrylates, nonyl (meth)acrylates, decyl (meth)acrylates and the like; and alkyl group of these monomers may be straight-chain or branched.

In these monomers, among alkyl (meth)acrylate monomers (A-1) containing 1–4 carbon atoms in the alkyl group, particularly preferred are those having an alkyl group containing 1 and/or 4 carbon atoms; and among alkyl (meth-)acrylate monomers (A-2) containing 5–10 carbon atoms in the alkyl group, particularly preferred are those having an alkyl group containing 8 carbon atoms. Also, acrylates are preferred over methacrylates, in view of the fact that polymers based on acrylates are difficult to be depolymerized and have improved oxidative resistance, and are capable of fully displaying the effects of FM agents. But, in case of acrylates having alkyl group containing 5–7 carbon atoms, poor solubility may occasionally cause turbidity when they are added to base oils such as iso-paraffin-containing high viscosity index oils and alpha-olefin oligomer synthetic lubricating oils. Thus, examples of preferable monomers include methyl (meth)acrylates, n-, i- or t-butyl (meth)acrylates, n-octyl (meth)acrylates, 2-ethylhexyl (meth)acrylates and the like; and particularly preferred are n-, i- or t-butyl acrylates, n-octyl acrylates and 2-ethylhexyl acrylates.

It is preferred to use (A-1) together with (A-2) or (A-2) alone. Thus, a preferable range exists as to the weight ratio of (A-1) to (A-2), and it is preferred that this ratio is within 0:100–30:70, particularly 5:95–20:80. In this range, polymer (B) provides improved low temperature viscosity characteristics and oxidation resistance, and improved solubility to high viscosity index oils and synthetic lubricating oils, together with fully displaying the effects of FM agents.

The viscosity index improver of the invention, comprising a polymer (B) containing at least 70% by weight of structural units of an alkyl (meth)acrylate monomer (A) containing not more than 10 carbon atoms in the alkyl group, such polymer may be one optionally additionally of one or more monomers containing at least one atom selected from the group consisting of nitrogen atom, oxygen atom and sulfur atom. Such additional monomers may be incorporated into the polymer by random copolymerization, graft copolymerization, graft addition and so on. It is preferred to also provide for properties such as detergency, dispersibility and oxidation resistance. Particularly preferred is providing detergency and dispersibility with oxidation resistance at the same time, since excellent heat resistance can be attained by the synergistic effects thereof with good oxidation resistance due to the viscosity index improver of this invention. Examples thereof providing detergency, dispersibility and oxidation resistance include those disclosed in U.S. Pat. Nos. 5,013,468, 5,013,470, EP 518,012, U.S. Pat. Nos. 4,606,834, 4,036,766, 4,036,768, 4,904,404, 4,812,261, 4,668,412, 4,790,948 and 4,795,577, JP Laid-open 110790/85, JP Laid-open 247719/86, JP Laid-open 51497/88, JP Laid-open 179999/88, JP Laid-open 193308/89, JP Laid-open 284593/89, JP Laid-open 141096/87, JP Laid-open 296811/90, JP Laid-open 211498/92 and JP Laid-open 158075/94. Illustrative thereof capable of imparting detergency and dispersibility by random copolymerization or graft copolymerization are N-vinylpyrrolidone, N-vinylthiopyrrolidone, vinylpyridines, N,N-dialkylaminoalkyl (meth)acrylates (alkyl group containing usually 1–4 carbon atoms), N,N-dialkylaminoalkyl(meth)acrylamides (alkyl group containing usually 1–4 carbon atoms), vinylimidazole, and morpholinoalkyl (meth)acrylates. Examples thereof capable of imparting detergency and dispersibility with oxidation resistance at the same time by similar copolymerization include various ones, such as monomers having the residue of aminophenothiazine, N-arylphenylenediamines, aminocarbazole, aminothiazole, aminoindole, aminopyrrole, aminoimidazoline, aminomercaptothiazole and aminopiperidine. Exemplary of compounds obtained by graft-wise addition are those obtainable by copolymerization of a small amount (for instance, 0.5–5%) of a carboxylic acid compound (such as maleic anhydride, methacrylic acid, crotonic acid and itaconic acid) with (meth)acrylate monomers, followed by amidation or imidation of the resulting copolymer with a (poly)amine or by Mannich reaction of the copolymer with formaldehyde and a (poly)amine. Besides, there may be mentioned those obtainable by grafting, to the polymer (B), a non-vinyl compound (such as phenothiazines, imidazoles, thiazoles, benzothiazoles, triazoles, thiazolidines, pyrimidines, piperazines, pyrrolidinones, oxazoles and thiomorpholines), using a radical catalyst or the like. The amount of these various compounds in the polymer (B) is usually at most 20 preferably at most 10%, more preferably at most 5%.

In this invention, polymer (B) may contain in the range of less than 30% by weight, preferably in the range of less than 20% by weight, structural units of another monomer (E) having polymerizable double bond other than alkyl (meth-)acrylate monomers (A) containing not more than 10 carbon atoms in the alkyl group.

Examples of the other monomers (E) having polymerizable double bond include alkyl (meth)acrylate monomers having alkyl group containing 11–20 carbon atoms (dodecyl methacrylate, tetradecyl methacrylate, hexadecyl methacrylate, octadecyl methacrylate, and acrylates having these alkyl groups); unsaturated monocarboxylic acid esters having alkyl group containing 1–30 carbon atoms (such as butyl crotonate, octyl crotonate, dodecyl crotonate and octyl crotonate); alkyl esters containing 1–30 carbon atoms in the alkyl group of unsaturated polycarboxylic acid (such as dibutyl maleate, dioctyl maleate, dilauryl maleate, distearyl maleate, dioctyl fumarate and dilauryl fumarate); nitrile group-containing compounds (such as acrylonitrile and methacrylonitrile); aromatic vinyl compounds (such as styrene and 4-methylstyrene). At least one monomer among these can be used as monomer (B). In case where (meth-)acrylates containing a hydroxyl group for an alkyl group are copolymerized, effects of an FM agent may in some case not be sufficiently displayed.

Among these monomers (E), preferred are alkyl (meth) acrylate monomers having alkyl group containing 11–20 carbon atoms, acrylonitrile and styrene. Use of alkyl (meth) acrylate monomers having alkyl group containing 10–20 carbon atoms as (m) is preferred, since good low-temperature flowability may occasionally attained without a pour point depressant. There can be obtained a high viscosity index by using an acrylonitrile monomer, and good thickening effects can be attained by using a styrene monomer.

If the amount of the monomer (E) exceeds 30% by weight in the structural units of the polymer (B), problems in oxidation resistance, low-temperature characteristics or solubility in lubricating oil may occur, as the case may be; or effects of an FM agent may not sufficiently displayed in some case. Said polymer (B) may be random copolymer of the monomer (E) and the monomer (A), or graft polymer of superstrate formed from the monomer (E) onto a backbone chain formed from the monomer (A).

The polymer (B) in this invention can be produced by known polymerization methods. For instance, the polymer may be produced by polymerizing the alkyl (meth)acrylate monomer (A) and optionally the above monomer (E), using a radical polymerization catalyst (such as azo compounds and peroxides), with or without a solvent; and control of molecular weight can be easily attained by carrying out polymerization with use of a chain transfer agent [for example, mercaptans, (alkyl)anilines, phenols, alcohols, amines and the like]. As solvents, preferred are mineral oils, synthetic hydrocarbon lubricating oils, such as decene oligomer, and synthetic ester lubricating oils, such as dioctyl adipate and trimethylolpropane fatty acid esters.

Weight-average molecular weight of the polymer (B) in this invention is generally 10,000–900,000, preferably 30,000–600,000. Sufficient thickening effects are not attained, when weight-average molecular weight is less than 10,000. When it exceeds 900,000, shear stability is poor and may pose a problem in practical use. The weight-average molecular weight is measured by GPC using calibration curve of polystyrene.

The viscosity index improver of the present invention is usually obtained in the form of a solution of the polymer (B) diluted and dissolved into an oil selected from the group consisting of mineral oils, high viscosity index mineral oils containing iso-paraffins obtainable by hydrocracking paraffins, synthetic hydrocarbon lubricating oils, synthetic ester lubricating oils, and mixtures of two or more of these. The concentration of the polymer (B) in the viscosity index improver of this invention is usually 30–80% by weight, preferably 40–70% by weight. There may be some cases where sufficient thickening effects and viscosity index improving ability are not attained, when it is less than 30% by weight, and the viscosity index improver becomes too viscous to be easily treated at more than 80% by weight.

It is preferred to further blend a pour point depressant (C) into the viscosity index improver of this invention. Pour point depressants (C) include known ones, for example, usual polyalkyl methacrylate pour point depressants (such as polymers mainly composed of n-tetradecyl methacrylate) and chlorinated paraffins/naphthalene condensates. Also, suitable are combinations of two or more these polyalkyl methacrylate, different in monomer composition and/or molecular weight (such as those disclosed in JP Patent Laid-open 70305/1979), and extremely high molecular weight ones (such as those disclosed in U.S. Pat. No. 5,229,021). Blending weight ratio of the polymer (B) to the pour point depressant (C) is preferably 80:20–99:1, particularly 90:10–95:5. Use of the pour point depressant in larger amount than the ratio of 80:20 may result in insufficient thickening effects, or else may cause separation of the polymer (B) and the pour point depressant because of poor compatibility; and use in lower amount than the ratio of 99:1 may result in poor pour point depressing effects.

The viscosity index improver of this invention is used to be blended and dissolved into said lubricating oil base oil (D) so as to provide a desired viscosity, whereby a lubricating oil of this invention is obtained. In general, base oils (D) include those having viscosity in a range of 50 neutral oil–300 neutral oil. Illustrative examples include usual mineral oils. Also, those base oils to which the viscosity index improver is added include synthetic lubricating oils (hydrocarbons, such as decene oligomer; esters, represented by fatty esters of alcohols such as trimethylolpropane, pentaerythritol and hexamethylene diol, fatty alcohol esters of adipic acid). In addition, there are suitable MLDW oils, prepared by mobil lube dewaxing process, specifically by isomerizing wax with a catalyst (such as synthetic zeolite) and removing unreacted wax. Particularly, the viscosity index improver of this invention is most effective in high viscosity index oils. These are quite different, with respect to composition and properties, from usual mineral oils and the like. These high viscosity index oils include those obtainable the process disclosed in Neth. Appln. 76 13854 and JP Patent Laid-open 214349/1993. That is, these are those containing i-paraffins obtainable by hydrocracking and isomerizing n-paraffins with the use of a catalyst. In general, synthetic zeolite, noble metal catalyst or the like is used as the hydrocracking catalyst at this stage. Further, solvent refined isomerized mineral oils containing i-paraffins thus prepared are also included within the invention. Such i-paraffin-containing isomerized mineral oils, which are significantly different in composition from usual solvent-refined mineral oils, have a high viscosity index of usually 110–160 or so depending upon the production method and the content of i-paraffin. (Usual mineral oils have viscosity index of 90–105 or so.) Also, high viscosity index oils are also good in oxidation resistance, since the content of aromatic compounds is very low. Therefore, preferred are lubricating oils containing the high viscosity index oil as a essential component. The improver of this invention is added to these lubricating oil base oil (D) usually in an amount of 1–30% by weight, to obtain the lubricating oil of this invention. Preferable results are obtained when the improver is added in an amount of 2–10% by weight when the lubricating oil is an engine oil and is added in an amount of 7–25% by weight when the lubricating oil is a gear oil and automatic transmission oil.

The viscosity index improver of the present invention has a characteristic that the maximum effects can be attained when used in conjunction with a molybdenum-containing FM agent. Examples of this FM agent include thiophosphates and carbamates. Illustrative are those disclosed in JP Patent Publication Nos. 29366/1969, 6362/1974, 964/1976, 31646/1978, 40593/1980, 32596/1991, 33390/1994 and 47675/1994. It is not clear why excellent FM property or low fuel cost can be attained when the viscosity index improver is used in conjunction with a FM agent. As compared with the case of using conventional ones, it is presumed that there may be formed a different complex with FM agent when using the viscosity index improver of this invention, whereby the decomposition rate would be changed.

The content of these FM agent in lubricating oil is usually 0.05–5% by weight, said improver is 0.5–30% by weight and lubricating oil base oil (D) is 99.45–65% by weight. Friction wear reducing effects are hardly attained when the FM agent is less than 0.05%; and the use in an amount more than 5% by weight provides substantially no difference in friction wear reducing effects from the case of 5% by weight or less and results in economic disadvantage.

The lubricating oil of this invention may contain other known additives. These known additives include, for example, viscosity index improvers known ones, such as ethylene-propylene copolymer and hydrogenated styrene-isoprene copolymer, ones having detergency dispersibility derived from these polyolefin viscosity index improvers by introducing nitrogen atoms therein; and conventional polyalkyl methacrylate viscosity index improvers; extreme pressure agents (for example, sulfur/phosphorus-containing ones, such as "Angramol" sold by Lubrizol, sulfur-containing ones, such as sulfurized olefins); detergents (such as calcium and magnesium perbasic salts of sulfonates, salicylates and naphthenates); dispersants (such as polyisobutenyl succinimide, Mannich condensates of alkylphenols and polyamines, and boric acid-modified products of these); anti-oxidants (such as zinc dithiophosphate, zinc dithiocarbamate, hindered phenols, hindered amines and alkyldiphenylamines); oiliness additives (such as fatty esters and fatty amides); rust inhibitors (for example alkylsuccinates, and sulfonates such as alkylbenzene sulfanates and alkylnaphthalene sulfonates); and anti-wear agent (for example, phosphorus-containing ones, represented by phosphate esters and phosphite esters).

The uses, for which the improver and lubricating oils of the invention are applied, include gasoline engine oils, diesel engine oils, gear oil, automotive transmission fluid, hydraulic oils, tractor oil, power steering oil, shock-absorber oil, compressor oil, and the like.

EXAMPLES

This invention is illustrated by Examples below, but the invention is not limited to these. In Examples, parts and % represents parts by weight and % by weight, respectively.

Examples 1

Into a reaction vessel equipped with a stirrer, a heater, a thermometer, a nitrogen inlet tube and a condensor, 300 parts of a 100 neutral mineral oil were charged, and heated to 85° C. after nitrogen substitution. A mixture of 70 parts of n-butyl acrylate, 630 parts of 2-ethylhexyl acrylate and 7 parts of azobisisobutyronitrile was added dropwise thereto continuously over 3 hours, followed by aging for additional an hour to obtain a 69% concentration solution of a copolymer having a weight average molucular weight of 50,000. To 93 parts of this solution, were added 7 parts of a polymethacrylate pour point depressant ("Aclube 133", produced by Sanyo Chemical Industries) to provide an improver (1) of this invention.

Example 2

Polymerization was carried out in the same manner as Example 1, except substituting 70 parts of n-butyl acrylate with 70 parts of methyl methacrylate, to obtain a 68% concentration solution of a copolymer having a weight average molucular weight of 50,000. To 95 parts of this solution, were added 5 parts of a polymethacrylate pour point depressant ("Aclube 132", produced by Sanyo Chemical Industries) to provide an improver (2) of this invention.

Example 3

Polymerization was carried out in the same manner as Example 1, except substituting 70 parts of n-butyl acrylate with 70 parts of styrene, to obtain a 69% concentration solution of a copolymer having a weight average molucular weight of 45,000. To 90 parts of this solution, were added 10 parts of a polymethacrylate pour point depressant ("Aclube 138", produced by Sanyo Chemical Industries) to provide an improver (3) of this invention.

Example 4

Polymerization was carried out tn the same manner as Example 1, except substituting 70 parts of n-butyl acrylate and 630 parts of 2-ethylhexyl acrylate with 105 parts of n-butyl acrylate, 490 parts of 2-ethylhexyl acrylate and 105 parts of n-decyl acrylate, to obtain a 69% concentration solution of a copolymer having a weight average molucular weight of 52,000. To 97 parts of this solution, were added parts of a polymethacrylate pour point depressant ("Aclube 138", produced by Sanyo Chemical Industries) to provide an improver (4) of this invention.

Example 5

Polymerization was carried out in the same manner as Example 4, except substituting 105 parts of n-decyl acrylate with a mixture of 50 parts of n-dodecyl methacrylate, 40 parts of n-tetradecyl methacrylate, 10 parts of n-hexadecyl methacrylate and 5 parts of n-octadecyl methacrylate, to obtain a 69% concentration solution of a copolymer having a weight average molucular weight of 49,000 to make an improver (5) of this invention.

Example 6

To 97 parts of the additive (5) of Example 5, were added 3 parts of a polymethacrylate pour point depressant "Aclube 133" to provide an improver (6) of this invention.

Example 8

Polymerization was carried out in the same manner as Example 1, using 70 parts of n-butyl methacrylate and 630 parts of 2-ethylhexyl methacrylate, to obtain a 68% concentration solution of a copolymer having a weight average molucular weight of 53,000. To 93 parts of this solution, were added 7 parts of a polymethacrylate pour point depressant "Aclube 133" to provide an improver (7) of this invention.

Example 8

Polymerization was carried out in the same manner as Example 1, except using 0.5 parts of azobisvaleronitrile instead of 7 parts of azobisisobutyronitrile, to obtain a copolymer having a weight average molucular weight of 188,000. To 93 parts of this copolymer, were added 7 parts of "Aclube 133" to provide an improver (8) of this invention.

Example 9

Polymerization was carried out in the same manner as Example 8, using monomers of Example 4, to obtain a copolymer having a weight average molucular weight of 195,000. To 97 parts of this copolymer, were added 3 parts of "Aclube 136" to provide an improver (9) of this invention.

Comparative Example 1

Polymerization was carried out in the same manner as Example 1, using 70 parts of n-butyl acrylate, 350 parts of 2-ethylhexyl acrylate, 180 parts of n-decyl acrylate and 100 parts of n-tetradecyl acrylate, to obtain a 68% concentration solution in mineral oil of a copolymer having a weight average molucular weight of 52,000. To 93 parts of this solution, were added 7 parts of "Aclube 133" to provide an improver (Comp.1) for comparison.

Comparative Example 2

Polymerization was carried out in the same manner as Example 1, using 70 parts of n-butyl acrylate, 350 parts of 2-ethylhexyl acrylate, 180 parts of n-dodecyl methacrylate and 100 parts of n-tetradecyl methacrylate, to obtain a 69% concentration solution in mineral oil of a copolymer having a weight average molucular weight of 47,000 to make an improver (Comp.2) for comparison.

Comparative Example 3

To 93 parts of the additive (Comp.2) of Comparative Example 2, were added 7 parts of "Aclube 133" to provide an improver (Comp.3) for comparison.

Comparative Example 4

Polymerization was carried out in the same manner as Example 1, using a mixture of 105 parts of methyl methacrylate, 350 parts of n-dodecyl methacrylate and 245 parts of n-tetradecyl methacrylate, to obtain a 69% concentration solution of a copolymer having a weight average molecular weight of 49,000 to make an improver (Comp.4) for comparison.

Comparative Example 5

Polymerization was carried out in the same manner as Example 1, using a mixture of 105 parts of methyl methacrylate, 280 parts of n-dodecyl methacrylate, 140 parts of n-tetradecyl methacrylate, 105 parts of n-hexadecyl methacrylate and 70 parts of n-octadecyl methacrylate to obtain a 69% concentration solution of a copolymer having a weight average molucular weight of 51,000 to make an improver (Comp.5) for comparison.

Comparative Example 6

Polymerization was carried out in the same manner as Example 1, except using 700 parts of dodecyl acrylate as the monomer, to obtain a copolymer having a weight average molucular weight of 51,000. To 93 parts of this polymer, were added 7 parts of "Aclube 133" to provide an improver (Comp.6) for comparison.

Comparative Example 7

Polymerization was carried out in the same manner as Example 8, using monomers of Comparative Example 4, to obtain a solution of a copolymer having a weight average molucular weight of 195,000. To 93 parts of this copolymer, were added 7 parts of "Aclube 133" to provide an improver (Comp.7) for comparison.

Comparative Example 8

Polymerization was carried out in the same manner as Example 8, using monomers of Comparative Example 6, to obtain a solution of a copolymer having a weight average molucular weight of 198,000. To 93 parts of this copolymer, were added 7 parts of "Aclube 133" to provide an improver (Comp.8) for comparison.

Use Examples 1–7 and Comparative Use Examples 1–5

Using each of the improvers (1)–(7) of this invention and the improvers (Comp.1)–(Comp.6) for comparison, low-temperature viscosity test and oxidation resistance test were carried out according to the following methods. The results are shown in Table 1.

(Low-temperature Viscosity Test Method)

In accordance with Low-temperature Viscosity Test Method for Gear Oil specified by Japan Petroleum Academy (JPI5S-26-85), 10 parts of of each of the improvers (1)–(7) and (Comp.1)–(Comp.6) was homogeneously dissolved into 90 parts of a 100 neutral mineral oil, and low-temperature viscosity at –40° C. was measured.

(Oxidation Resistance Test Method)

In accordance with JIS K28140, 10 parts of of each of the improvers (1)–(7) and (Comp.1)–(Comp.6) was homogeneously dissolved into 90 parts of a 100 neutral mineral oil. and oxidation resistance test was carried out for 98 hours at 165.5° C., followed by measuring the amounts of sludge according to Method B. Method B comprises adding a sludge flocculant to the lubricating oil after the test and then centrifuging the precipitated sluge. The amount of sludge according to Method B represents oxidative resistance.

TABLE 1

| | | Sample (Improver) | Viscosity at –40° C. (cSt) | Sludge Amount (%) |
|---|---|---|---|---|
| Use Example | 1 | (1) | 38000 | 1.6 |
| | 2 | (2) | 48000 | 1.6 |
| | 3 | (3) | 55000 | 2.2 |
| | 4 | (4) | 44000 | 1.9 |
| | 5 | (5) | 57000 | 2.6 |
| | 6 | (6) | 49000 | 2.6 |
| | 7 | (7) | 61000 | 2.9 |
| Comparative Use Example | 1 | (Comp. 1) | 102000 | 3.6 |
| | 2 | (Comp. 2) | 125000 | 4.5 |
| | 3 | (Comp. 3) | 95000 | 4.4 |
| | 4 | (Comp. 4) | 101000 | 4.8 |
| | 5 | (Comp. 5) | 89000 | 4.5 |
| | 6 | (Comp. 6) | 81700 | 3.4 |

Use Examples 8–15 and Comparative Use Examples 7–11

To a high viscosity index 100 neutral oil having viscosity index of 131 or to a usual mineral oil, was added and homogeneously mixed each of the viscosity index improvers of Examples 1–7 and Comparative Examples 1–6 in an amount of 12–13% to adjust a viscosity in the range of 7.4–7.8 cSt at 100° C. required for automatic transmission oil. Using thus adjusted oils, viscosity at –40° C. was measured in the same manner as Use Example 1–7 to obtain the results shown in Table 2.

As apparent from Table 2, the improvers of this invention, which provide lower low-temperature viscosity also to usual mineral oil, exhibit remarkable effects and provide much lower low-temperature viscosity when added to high viscosity index oil.

TABLE 2

| | | Sample (Improver) | Base Oil: High Viscosity Index Oil | Base Oil: Solvent-refined Mineral Oil |
|---|---|---|---|---|
| Use Example | 8 | (1) | 18600 | 59400 |
| | 9 | (2) | 27200 | 67500 |
| | 10 | (3) | 28800 | 72200 |
| | 11 | (4) | 20100 | 65100 |
| | 12 | (5) | 34300 | 69100 |
| | 13 | (6) | 23200 | 68400 |
| | 14 | (7) | 40200 | 79200 |
| Comparative Use Example | 7 | (Comp. 1) | 101000 | 149000 |
| | 8 | (Comp. 2) | 125000 | 185000 |
| | 9 | (Comp. 3) | 113000 | 128000 |
| | 10 | (Comp. 4) | 133000 | 146000 |
| | 11 | (Comp. 5) | 144000 | 117000 |
| | 12 | (Comp. 6) | 99600 | 98400 |

Use Examples 15–16 and Comparative Use Examples 13–14

To 85.1% of a high viscosity index oil having viscosity index of 131 or a usual solvent-refined mineral oil, were added 3.9% of each of the improver (8) of this invention and the improver (Comp.7) for comparison, 1% of molybdenum dithiophosphate FM agent ("Sanflick FM-2", produced by Sanyo Chemical Industries.) and 10% of package additives for engine oil (SG standard otl) to adjust a viscosity in the range of 10.0–10.4 cSt at 100° C. required for engine oil. To 85.1% of a high viscosity index otl having viscosity index of 131 or a usual solvent-refined mineral oil, were added 3.9% of each of the improver (9) of this invention and the improver (Comp.8) for comparison, 1% of molybdenum dithiocarbamate FM agent ("MOLYVAN A", produced by R. T. Vanderbtlt Co.) and 10% of package additives for engine oil (SG standard oil) to adjust a viscosity in the range of 10.0–10.4 cSt at 100° C. required for engine otl. Oxidation resistance test of these blended oils was carried out, in accordance with JIS K2514, at 165.5° C. During this test, sampling 10 g each was done at intervals of 24 hours. Friction coefficient of each sample after oxidative degradation for period was measured using an friction tester of SRV Co., under conditions of 50° C. temperature, 50 newton load and 50 Hz frequency to obtain the results shown in Table 3.

TABLE 3

| | | Sample (Improver) | Oxidative Degradation Period | Base Oil: High Viscosity Index Oil | Base Oil: Solvent-refined Mineral Oil |
|---|---|---|---|---|---|
| Use Example | 15 | (8) | 0 hour | 0.08 | 0.08 |
| | | | 24 | 0.11 | 0.13 |
| | | | 48 | 0.14 | 0.18 |
| | | | 72 | 0.18 | 0.22 |
| | 16 | (9) | 0 hour | 0.10 | 0.10 |
| | | | 24 | 0.15 | 0.18 |
| | | | 48 | 0.19 | 0.22 |
| | | | 72 | 0.23 | 0.26 |
| Comparative Use Example | 3 | (Comp. 7) | 0 hour | 0.07 | 0.08 |
| | | | 24 | 0.19 | 0.25 |
| | | | 48 | 0.28 | 0.34 |
| | | | 72 | 0.39 | 0.45 |
| | 4 | (Comp. 8) | 0 hour | 0.10 | 0.08 |
| | | | 24 | 0.25 | 0.29 |
| | | | 48 | 0.34 | 0.36 |
| | | | 72 | 0.40 | 0.43 |

As apparent from Table 3, lubricating oils containing the improvers of this invention are recognized to show lower friction coefficient after oxidative degradation.

INDUSTRIAL UTILITY

As described above, the viscosity index improver of the present invention exhibits improved low-temperature viscosity characteristics and oxidation resistance, as compared with conventional methacrylate polymer viscosity index improvers. It gives extremely low viscosity at −40° C., particularly when used in high viscosity index oils. Besides, when used in conjunction with a molybdenum-containing FM agent, it has a characteristic of providing low friction coefficient even after oxidative degradation. Thus, lubricating oil of this invention, prepared using the improver of the invention, shows improved low-temperature flow properties and oxidatlve stability at high temperature, and are usable even under severe circumstances and of improved reduced fuel cost.

We claim:

1. A lubricating oil composition, which comprises a lubricating oil base oil (D), comprising an isoparaffin-containing high viscosity index mineral oil and a viscosity index improver added thereto, comprising a polymer (B) containing at least 70% by weight of structural units of an alkyl acrylate or methacrylate monomer (A) containing not more than 10 carbon atoms in the alkyl group.

2. The composition of claim 1, wherein (A) is an alkyl acrylate containing not more than 10 carbon atoms in the alkyl group.

3. The composition of claim 1, wherein (A) comprises a combination of an alkyl acrylate or methacrylate (A-1) containing 1–4 carbon atoms in the alkyl group with an alkyl acrylate or methacrylate (A-2) containing 5–10 carbon atoms in the alkyl group, or (A-2) alone.

4. The composition of claim 3, wherein (A-1) is an alkyl acrylate containing 1 or 4 carbon atoms in the alkyl group, and (A-2) is an alkyl acrylate containing 8 carbon atoms in the alkyl group.

5. The composition of claim 3, wherein the weight ratio of (A-1) to (A-2) is 0:100–30:70.

6. The composition of claim 1, wherein (B) contains less than 30% by weight of structural units of an alkyl acrylate or methacrylate monomer containing 11–20 carbon atoms in the alkyl group.

7. The composition of claim 1, which further comprises a pour point depressant (C).

8. The composition of claim 7, wherein the weight ratio of (B) to (C) is 80:20–99:1.

9. An engine oil, gear oil, automatic transmission fluid, power steering oil or shock absorber oil, comprising the composition of claim 1.

10. The composition of claim 1, which further comprises a molybdenum-containing antiwear agent added thereto.

11. The composition of claim 10 which comprises 0.5–30% by weight of said improver, 0.05–5 by weight of molybdenum-containing antiwear agent, and 99.45–65 by weight of the lubricating oil base oil (D).

12. The composition of claim 1, which contains said improver in an amount of 1–30% by weight.

13. The composition of claim 1, wherein said high viscosity index mineral oil is at least one member selected from the group consisting of isomerized mineral oils prepared by hydrocracking, isomerizing n-paraffins and solvent-refined products thereof.

14. The composition of claim 1, wherein (A) is at least one member selected from the group consisting of methyl acrylate, n-butyl acrylate, i-butyl acrylate, t-butyl acrylate, n-octyl acrylate, 2-ethylhexyl acrylate and methacrylates corresponding to these acrylates.

15. The composition of claim 1, wherein (A) is at least one member selected from the group consisting of n-butyl acrylate, i-butylacrylate, t-butyl acrylate, n-octyl acrylate and 2-ethylhexyl acrylate.

16. The composition of claim 1, wherein (B) contains at most 30% by weight of structural units of at least one monomer having at least one atom selected from the group consisting of nitrogen, oxygen and sulfur, said monomer units being introduced into (B) by random copolymerization, graft copolymerization or graft addition.

17. The composition of claim 1, wherein (B) contains less than 30% by weight of structural units of other monomer (E) having a polymerizable double bond, selected from the group consisting of alkyl acrylate or methacrylate monomers having an alkyl group containing 11–20 carbon atoms, unsaturated monocarboxylic acid esters having an alkyl group containing 1–30 carbon atoms, alkyl esters containing 1–30 carbon atoms in the alkyl group of an unsaturated polycarboxylic acid, nitrile group-containing compounds and aromatic vinyl compounds.

18. The composition of claim 7, wherein (C) is at least one member selected from the group consisting of polyalkyl methacrylate pour point depressants and chlorinated paraffins/naphthalene condensates.

19. The composition of claim 10, wherein said antiwear agent is selected from the group consisting of molybdenum-containing thiophosphates and molybdenum-containing carbamates.

20. A method for improving viscosity index and reducing fuel cost in an engine oil, gear oil, automatic transmission fluid, power steering oil or shock absorber oil, which comprises using an isoparaffin-containing high viscosity index mineral oil as the base oil, and adding thereto a viscosity index improver comprising a polymer (B) containing at least 70% by weight of structural units of an alkyl acrylate or methacrylate monomer (A) containing not more than 10 carbon atoms in the alkyl group.

* * * * *